US006257973B1

(12) United States Patent
Fernand Guiselin

(10) Patent No.: US 6,257,973 B1
(45) Date of Patent: Jul. 10, 2001

(54) COATED ABRASIVE DISCS

(75) Inventor: Olivier Léon-Marie Fernand Guiselin, Williamsville, NY (US)

(73) Assignee: Norton Company, Worcester, MA (US)

( * ) Notice: Subject to any disclaimer, the term of this patent is extended or adjusted under 35 U.S.C. 154(b) by 0 days.

(21) Appl. No.: 09/433,439

(22) Filed: Nov. 4, 1999

(51) Int. Cl.[7] ..... B24D 11/00

(52) U.S. Cl. ..... 451/539; 451/526; 451/536; 451/533

(58) Field of Search ..... 451/540, 548, 451/550, 539; 125/12, 13.01

(56) References Cited

U.S. PATENT DOCUMENTS

| | | | | |
|---|---|---|---|---|
| 2,137,201 | * | 11/1938 | Boyer | 451/548 |
| 2,137,329 | * | 11/1938 | Boyer | 451/548 |
| 2,309,016 | * | 1/1943 | Ryan | 451/548 |
| 2,451,295 | * | 10/1948 | Metzger et al. | 451/548 |
| 2,496,352 | * | 2/1950 | Metzger et al. | 451/548 |
| 2,555,001 | * | 5/1951 | Ohl | 451/548 |
| 2,978,847 | * | 4/1961 | Shoenmakers | 451/548 |
| 3,955,324 | | 5/1976 | Lindstrom . | |
| 3,991,527 | | 11/1976 | Maran . | |
| 4,317,660 | | 3/1982 | Kramis et al. . | |
| 5,380,390 | | 1/1995 | Tselesin . | |
| 5,503,592 | * | 4/1996 | Neumann | 451/548 |

* cited by examiner

*Primary Examiner*—Derris H. Banks
(74) *Attorney, Agent, or Firm*—David Bennett

(57) ABSTRACT

The invention provides individually made abrasive discs with the primary abrasive surface around the periphery of the disc where the bulk of the abrading action occurs when the disc is in use. The invention also provides a process by which these discs can be made using a unique grain feeding technique which is capable of depositing abrasive grain on a backing surface accurately and in annular patterns.

5 Claims, 4 Drawing Sheets

COATED ABRASIVE DISCS

BACKGROUND TO THE INVENTION

The present invention relates to coated abrasive discs and to an economical method of making coated abrasive discs adapted for easy modification to meet specific requirements.

Traditionally abrasive discs comprise a substrate which may be made of polymer film, paper, or a knit, woven or stitch-bonded fabric. The backing may need to be "filled" to ensure that a binder applied thereto does not become absorbed into the material. This may be referred to as a "size" and may be applied to the front, back or both sides. A binder, called the "make" coat, is applied to the backing and before the binder is cured, abrasive grits are applied to the binder and the binder is then cured to anchor the grits in place. A second binder layer also, (perhaps confusingly), called a "size" coat, is usually applied over the grits to complete the anchoring of the grits.

In conventional manufacturing the above process is applied to a continuous sheet and the individual discs are punched out from a large roll of the sheet, called a "jumbo". Even with the closest possible spacing of the punched out shapes, there is a significant amount of waste in terms of backing, abrasive grain applied and binder used to anchor the grain. The larger the disc diameter, the larger the amount of waste. In addition the production method requires that the disc have a uniform construction at all points since the same jumbo may be used to produce discs of various diameters and even belts.

However, the way an abrasive disc is conventionally used, only the outside edge of the disc is actually used before the disc is considered worn out because of the angle at which the disc is presented to the workpiece. Thus the usual methods of making the discs is wasteful as made from a jumbo and as used in practice.

The present invention provides a means of making abrasive discs more economically and this leads to the possibility of making novel abrasive disc structures that can be designed to provide significant advantages over the prior art.

SUMMARY OF THE INVENTION

The whole concept of the design of a coated abrasive disc is changed when it is appreciated that abrasive discs can be individually made rather than cut from a larger jumbo roll and the present invention was stimulated by the realization by the inventor that a technique could be devised by which abrasive disc could be individually produced and specifically designed for the intended application. The present invention therefore provides an abrasive disc having first and second major surfaces, said first surface having a primary abrasive area which covers only the outer peripheral portion of the first surface and extends from the periphery to a point that is at least 10% and up to 50% of the radial distance to the center of the disc. The primary abrasive area of the disc is preferably provided with a premium abrasive-containing abrasive layer. The balance of the surface of the disc, (the central area), can be devoid of abrasive or possibly covered by less abrasive or by a different, perhaps more friable, abrasive or an abrasive mixture in which a lower quality abrasive predominates. Very often the transition from primary abrasive area to the central area is not abrupt but more gradual with some degree of overlap between an area bearing a higher quality abrasive and one bearing a lesser quality abrasive, thereby masking the transition.

The central area need not be uniform and indeed it is often desirable to define two or more portions within the central area. Thus the central area can comprise one or more outer annular sections and an axial section. Outer annular sections can form a transition between the primary abrasive area and the axial section which can be devoid of abrasive. The outer annular sections can comprise progressively less abrasive, (even the premium abrasive used in the primary abrasive surface), with distance from the periphery, or the abrasive can be a mixture of inferior with the superior abrasive with the inferior proportion increasing with distance from the periphery. Generally, though not essentially, the axial or innermost, section is left devoid of abrasive altogether since it never contacts a workpiece. It can however be covered by a lower quality abrasive if desired.

The abrasive material in the primary abrasive area is typically fused or sintered alumina, silicon carbide or fused alumina/zirconia. It is however preferably a premium, in the sense of being more effective for the desired application, abrasive However it is to be understood that the "premium" quality can also derive only from the comparison with the amount and quality of the abrasive (if any) in the central area of the disc. Thus where there is no abrasive as such in the axial section of the disc, the most common fused aluminum oxide can become the "premium" abrasive. By the same token if the abrasive in the peripheral primary abrasive area is a filamentary sintered sol-gel alumina abrasive, fused alumina could certainly be incorporated in some or all of the central area of the disc as an "lower quality" abrasive. More generally however, where the central area of the disc has a coating comprising a lower quality abrasive material this can even be sand, a crushed mineral such as limestone, ground glass, particulate ash or clinker and the like.

The abrasive can be bonded to a substrate using a maker layer or the abrasive can be dispersed in a curable bond material which is applied to a backing material and subsequently cured. The latter technique is more often used with finer grade abrasive materials used primarily for developing surfaces with fine finishes. The most useful field for the application of the present invention is in the production of abrasive discs in which a disc backing material first receives a maker coat of a curable resin formulation and the abrasive is applied to the backing material either by a gravity feed or by electrostatic projection and the maker is then at least partially cured before a size coat of a resin compatible with the resin providing the maker coat is deposited over the abrasive grains. Cure is typically then finished for maker and size coats simultaneously. A supersize coat comprising a surface properties modifying additive, (such as a lubricant, anti-static additive or a grinding adjuvant), dispersed in a curable binder resin can be applied over the size coat if desired.

The backing material upon which the abrasive material is deposited can fibrous, paper or film. Fibrous backing materials are most frequently encountered in the applications for which the present invention is primarily useful though there is nothing inherent in the invention that so limits its scope. The fibrous backings may be based on woven fabrics, non-woven materials such as stitch-bonded fabrics, needled felts, or knit fabrics. Such a fibrous backing material is typically pre-sized with a filler in a back-size or front-size so as to fill up the pores of the fabric before the maker coat is applied such that the maker coat remains essentially on the surface. In some cases the fibers are completely or almost completely embedded in a thermoplastic or thermosetting resin matrix in which case pre-sizing of the substrate is not required.

The present invention also comprises a process for the manufacture of abrasive discs having a peripheral primary abrasive area extending from 10 to 50% of the distance from the periphery of the disc to the center which comprises feeding an abrasive grain to a grain deposition surface over the outer surface of a cone such that the deposition surface receives an annular deposition of the grain. The grain deposition surface can be the primary abrasive area itself where the disc comprises a backing material that has been coated with a maker coat and if the deposition of the grain is by a gravity technique. More often however it is a surface, such as a moving belt surface, from which the grain will deposited by a UP technique on to a disc of a backing material that has been coated with a maker coat. The deposition surface is preferably provided with a circular peripheral wall defining the area from which the grain will be projected during the UP deposition process. This helps to concentrate the grain on a specific area of the grain deposition surface and avoids any losses to the surroundings.

Where it is desired to provide annular rings comprising different abrasive grains within the central area of the abrasive disc, this can readily be accomplished by providing a series of cones with different greatest diameters but a common axis accommodated within the cone over which the abrasive grain is distributed for deposition on the primary abrasive area. In each case the grain is preferably distributed over the surface of the cone through distribution channels feeding only that specific surface. Uniformity of distribution within the distribution channels can be promoted by interposing one or more horizontal screens between the point at which the grain enters the distribution channel and the point at which it is discharged on to the distribution surface. Such screens are preferably agitated while grain is passing through the screens to promote uniform distribution within the channel.

DESCRIPTION OF PREFERRED EMBODIMENTS

Figure 1:
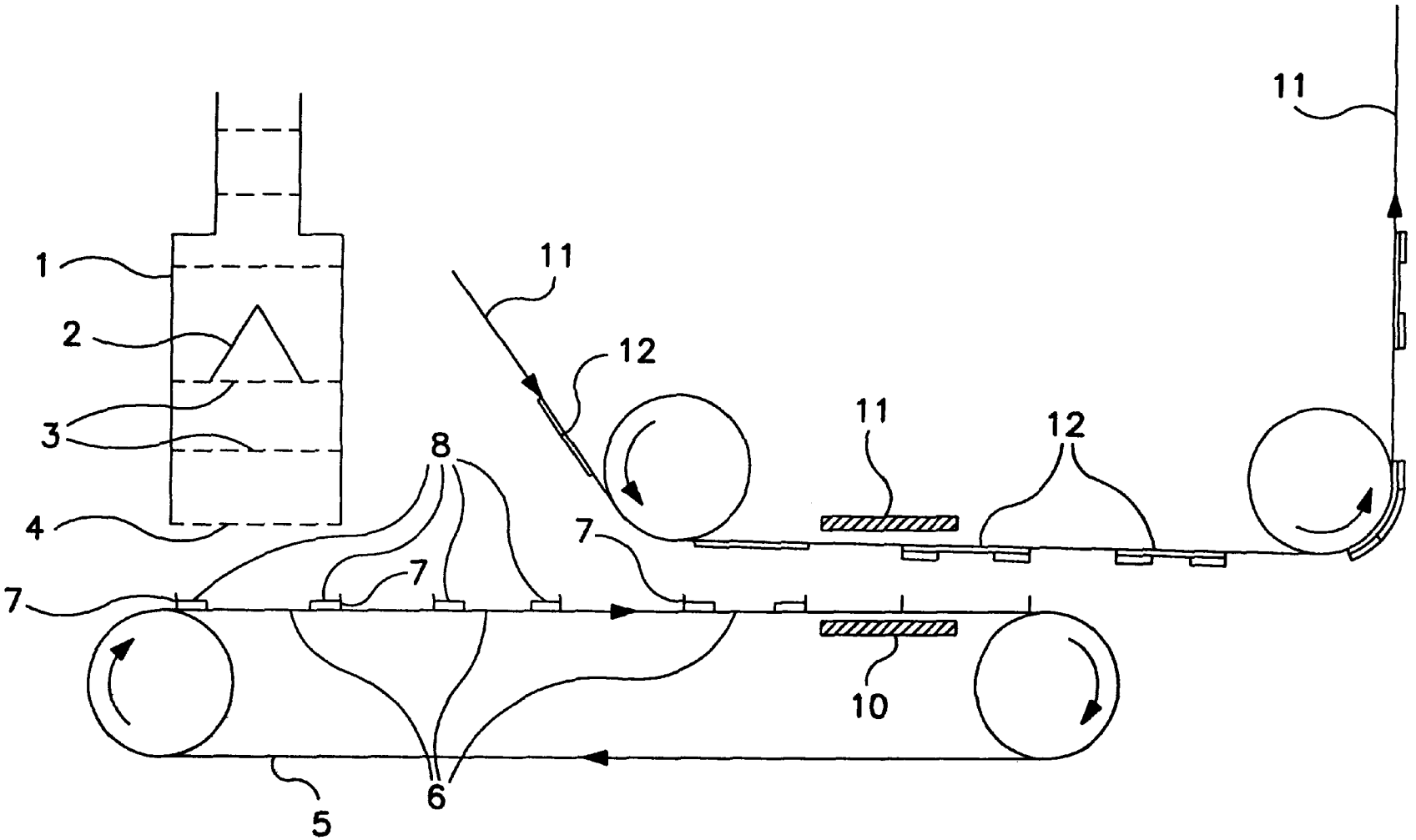
FIG. 1 is process flow diagram of an apparatus for UP deposition of grain from a grain deposition surface according to the process of the invention.

The invention is now described with reference to the embodiments described in the Drawings which are included for the purposes of illustration and are not intended to imply any necessary limitation of the essential scope of the invention.

In FIG. 1 a cylindrical grain distribution tower, 1, having an axially central distribution cone, 2, resting on one of a plurality of screens, 3, horizontally disposed at different heights within the tower. The bottom of the tower is closed by a metering screen, 4, which can be opened to deposit grain on a grain feed belt, 5, provided with a plurality of grain deposition stations, 6, defined by circular peripheral walls, 7, at intervals along the belt. Each deposition station in turn passes beneath the grain deposition tower such that grain can be deposited directly from the tower into a grain deposition station in the desired pattern, 8. The deposited grain in the grain deposition station then passes over a charged plate, 9, located below the grain feed belt, 5, and opposite a grounded plate, 10. Together the charged plate and grounded plate constitute a UP deposition station.

A carrier belt, 11, bearing discs, 12, of a backing material coated on one surface with a maker coat enters the deposition station with the timing such that a disc, 12, is in exact register with a deposition station, 6, bearing grain, 8, as both enter the UP deposition station such that the grain is projected upwards and adheres to the maker coat on the disc replicating essentially the pattern in which it was deposited in the grain deposition station. From the UP deposition station, the disc proceeds to a curing station (not shown) in which it is at least partially cured before receiving a size coat and a final cure.

Figure 2A:
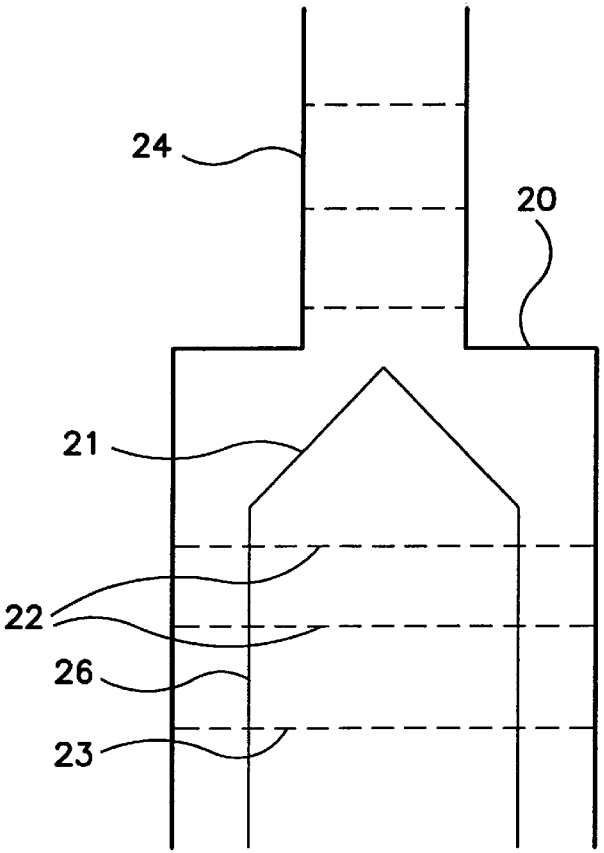
FIGS. 2(*a*), (*b*) and (*c*) are sketches of grain distribution systems that can be used in a process to produce abrasive discs according to the invention.
Figure 2B:
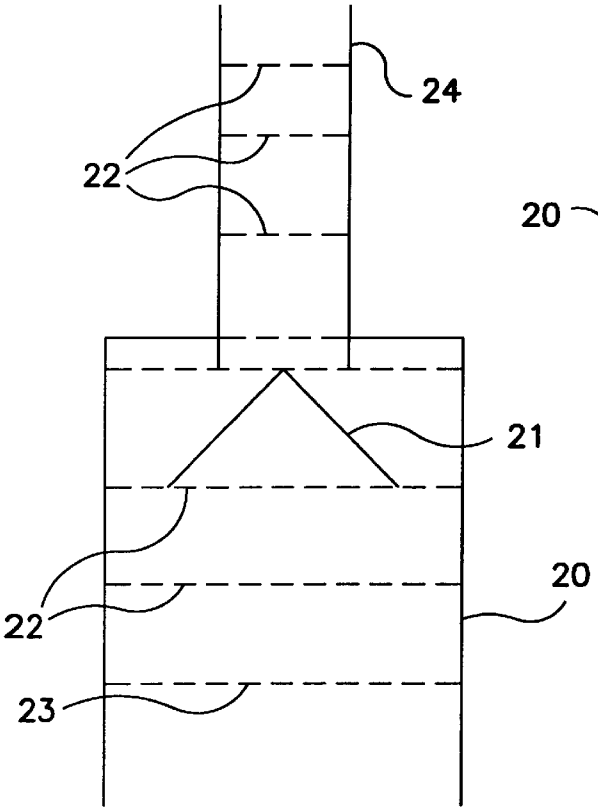
Figure 2C:
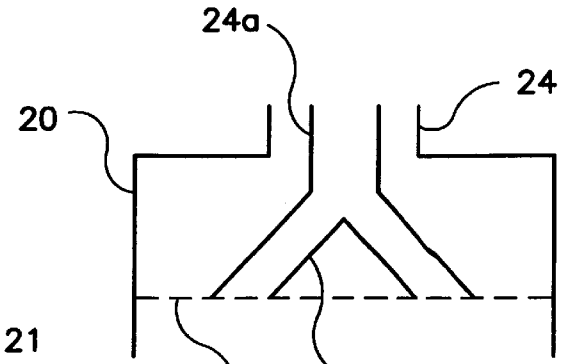

The grain deposition tower can have a wide variety of designs, three of which are shown in FIGS. 2 (*a*), (*b*) and (*c*) in each of which an outer cylindrical tower, 20, encloses an inner distribution cone, 21 and a plurality of screens, 22, the lowest of which, 23, is a metering screen. An upper co-axial extension of the cylindrical tower, 24, with a reduced diameter is provided as a grain feed mechanism.

Where two deposition passages are provided, a second co-axial extension, 24*a*, is provided as shown in FIG. 2(*c*) through which grain can be fed to the annular passage defined by the inner distribution cone and an outer distribution cone, 25.

The inner cone can be provided with a cylindrical extension, 26, co-axial with the cylindrical tower and extending below the open end of the cone. This provides a much sharper distinction between the primary abrasive area and the central area.

Figure 3A:
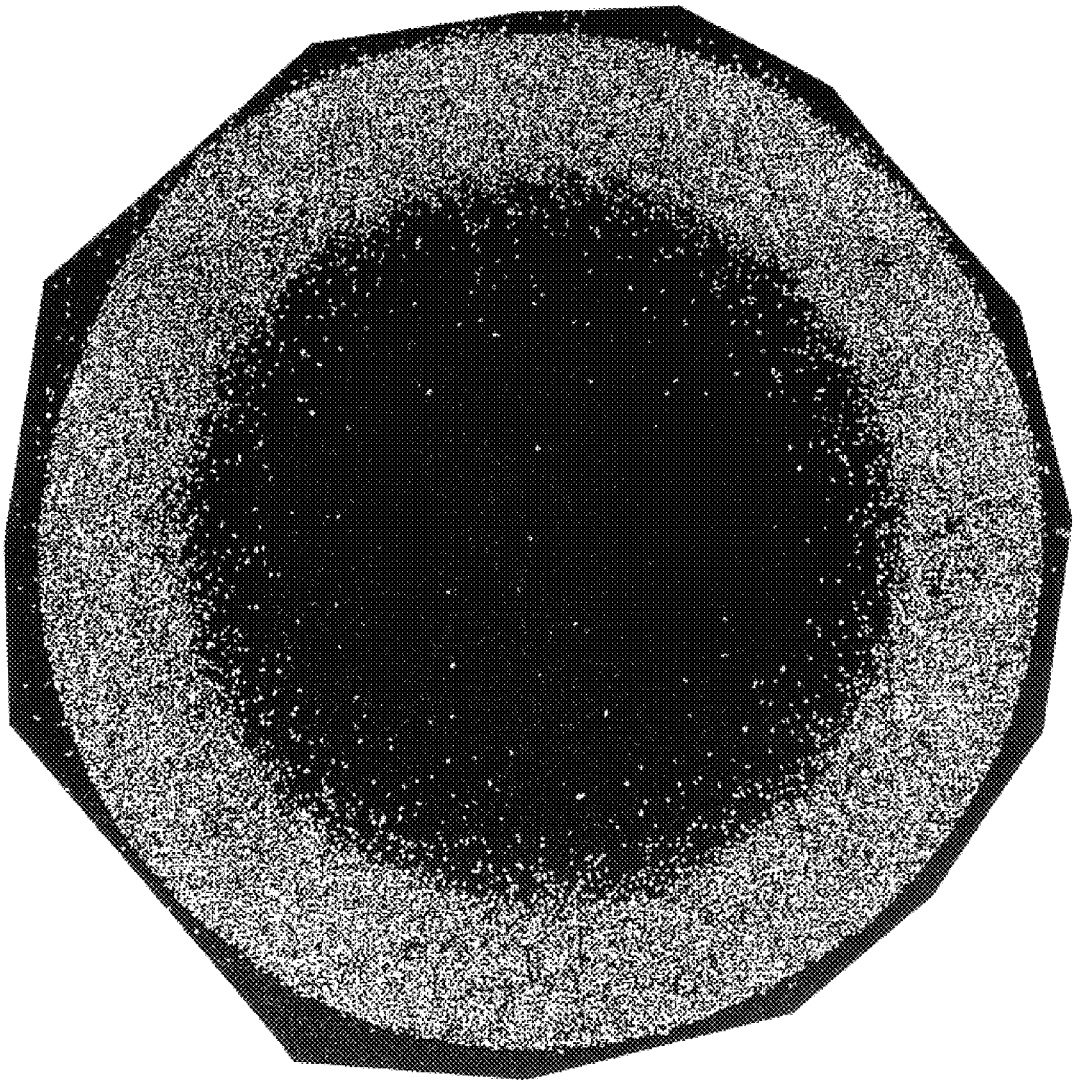
FIGS. 3 (*a*) and (*b*) show different grain distribution patterns that can be achieved using the process of the invention.
Figure 3B:
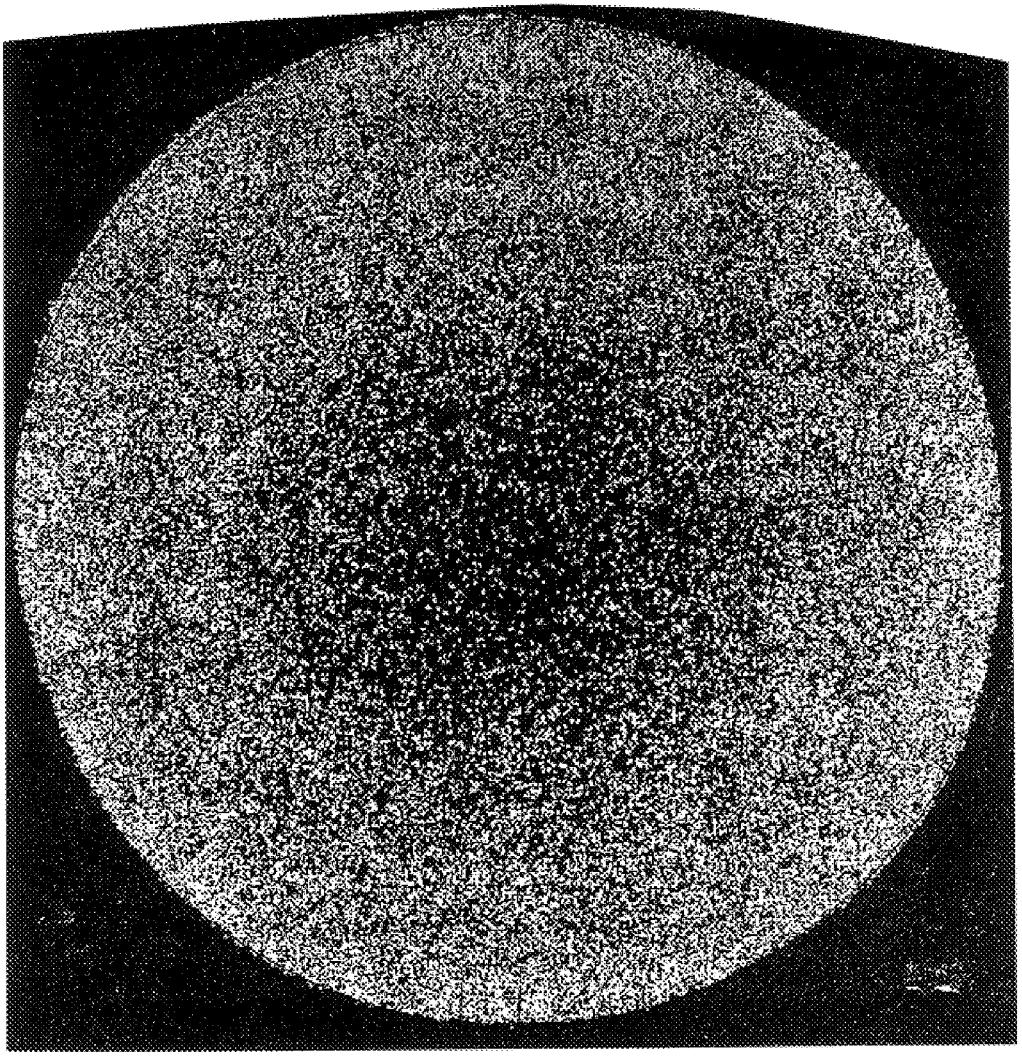

Each drawing of FIG. 2 is cross-sectional diagrammatic representation of a specific design. FIG. 2(*a*) would give a primary abrasive surface in the form of a peripheral ring such as is illustrated in FIG. 3(*a*). The tower shown in FIG. 2(*b*) would give a less well-defined inner edge to the primary abrasive surface such as is shown in FIG. 3(*b*). The design in FIG. 2(*c*) would be used to introduce an annular ring of an secondary abrasive in the central area and within the primary abrasive area by feeding the secondary grain into the space between the inner distribution cone, 21, and the outer distribution cone, 25, while the primary grain is fed over the outer surface of the outer distribution cone.

When the lowest screen, (the metering screen), is located at the bottom of the cylindrical tower, the grain is deposited in a quite tight distribution pattern. If the lowest screen is higher within the tower, the edges of the distribution pattern, particularly the inner edge, are much less well-defined.

It will be readily appreciated that, by varying the location and relative dimensions of the distribution cones, it is possible to produce a range of annular deposition patterns.

We claim:

1. An abrasive disc comprising a backing material selected from the group consisting of paper, fiber and film materials, said backing material having first and second major surfaces, said first surface having applied thereto a primary abrasive area which covers only the outer peripheral portion of the first surface and extends from the periphery to a point that is at least 10% and up to 50% of the radial distance to the center of the disc and a central area covers the rest of the first surface.

2. An abrasive disc according to claim 1 in which the central area is provided with an abrasive of lower quality than the abrasive deposited in the primary abrasive area.

3. An abrasive disc according to claim 1 in which the central area bears a lesser volume of grain per unit area than the primary abrasive area.

4. An abrasive disc according to claim 1 in which the central area comprises at least two concentric annular zones with degrees of inferiority to the primary abrasive area in terms of abrasive quality, that increase with distance from the periphery of the disc.

5. An abrasive disc according to claim 1 in which at least the part of the central area closest to the center of the disc is essentially devoid of abrasive.

* * * * *